United States Patent [19]

Baker

[11] Patent Number: 4,629,114

[45] Date of Patent: Dec. 16, 1986

[54] HEATER DEVICE CONTROL

[76] Inventor: Hailey L. Baker, 3551 Todds Rd., Lexington, Ky. 40509

[21] Appl. No.: 424,160

[22] Filed: Feb. 28, 1983

[51] Int. Cl.[4] ..... F23N 5/04

[52] U.S. Cl. ..... 236/11; 126/112; 237/51

[58] Field of Search ..... 432/37; 126/112, 110, 126/77; 237/51; 236/10, 11

[56] References Cited

U.S. PATENT DOCUMENTS 4,194,688 3/1980 Cobos ..... 126/112 X 4,206,743 6/1980 Niemela ..... 126/112 X

*Primary Examiner*—Henry Bennett

[57] ABSTRACT

The present invention provides a heating device including a combustion chamber for burning a selected fuel where the combustion chamber is at least partially surrounded by air heating plenums through which ambient air is forced. A portion of the air supplied to the plenum chamber is supplied to the combustion chamber to support combustion of the fuel and the device further includes a combustion air flow control device operated by a bi-metallic temperature sensing element located in an outlet of the heated air stream to attenuate flow of combustion air to the combustion chamber in response to change in the temperature of the heated air.

2 Claims, 9 Drawing Figures

HEATER DEVICE CONTROL

BACKGROUND OF THE INVENTION

The present invention relates to new and useful improvements in furnaces for burning solid fuel and has particular reference to furnaces especially adapted for the burning of wood or coal as a fuel.

Wood burning stoves or furnaces have in recent years enjoyed a resurgence of popularity in direct proportion to increasing cost of normal energy sources such as fuel oil, natural gas and electricity.

Conventionally such stoves included a fire box which is located with an opening to the fire box for refueling. Air is in general circulated around the fire box to provide heating for air to be supplied to a space to be heated.

In the prior art arrangements one disadvantage has been that a fire bed of wood or coal once ignited tends to continue to burn until it is consumed regardless of whether the zone being heated actually requires or needs heat at any given time.

The prior art has addressed this problem as shown in U.S. Pat. No. 423,653 where a bi-metallic temperature element is provided to operate a hinged door where the bi-metallic temperature element senses the temperature of the stove and controls air flow in response to firebox temperatures. While such an arrangement has provided some advantages over the art prior, the reference has inherent disadvantages which are overcome by arrangements provided by the present invention.

Other prior art references relate to regulation of combustion to a combustion chamber are shown in U.S. Pat. Nos. 4,074,854-Kamper; 1,834,958-Martin; 177,121-Hayes; 4,149,671-Cagle.

No prior art reference is known where a bi-metallic temperature control device is placed in the stream of air emitted from the furnace to the space to be heated and operates a combustion air flow device to regulate the flow of combustion air to the the combustion chamber in accordance therewith.

SUMMARY OF THE INVENTION

The present invention provides a new and useful arrangement for controlling the flow of combustion air to a fuel burning device and more particularly to the combustion chamber of a fuel burning device where the flow of combustion air is modulated in accordance with the temperature of the heated air emitted from the furnace. In one embodiment of the present invention the flow of combustion air to the combustion chamber can be attenuated directly in accordance with the temperature of the air flowing to the space to be heated and overall adjustment can be provided to change the desired set point of the temperature of the air admitted to the space to be heated.

More particularly, the present invention provides a combustion chamber for burning a selected fuel where the combustion chamber is at least partially surrounded by air heating plenums through which ambient air is forced where a portion of the air supplied to the plenum chambers is supplied to the combustion chamber to support combustion of the fuel and further including a combustion air flow control device operated by a bi-metallic temperature sensing element located in an outlet of the heated air stream to the space to be heated.

Examples in accordance with the present invention are shown in the accompanying Figures, but it will be understood that various other arrangements also within the scope of the present invention will occur to those skilled in the art upon reading the disclosure set forth hereinafter.

BRIEF DESCRIPTION OF THE DRAWINGS

Examples of devices in accordance with the present invention are shown in the accompanying Figures wherein.

DETAILED DESCRIPTION OF THE DRAWINGS

Figure 1:
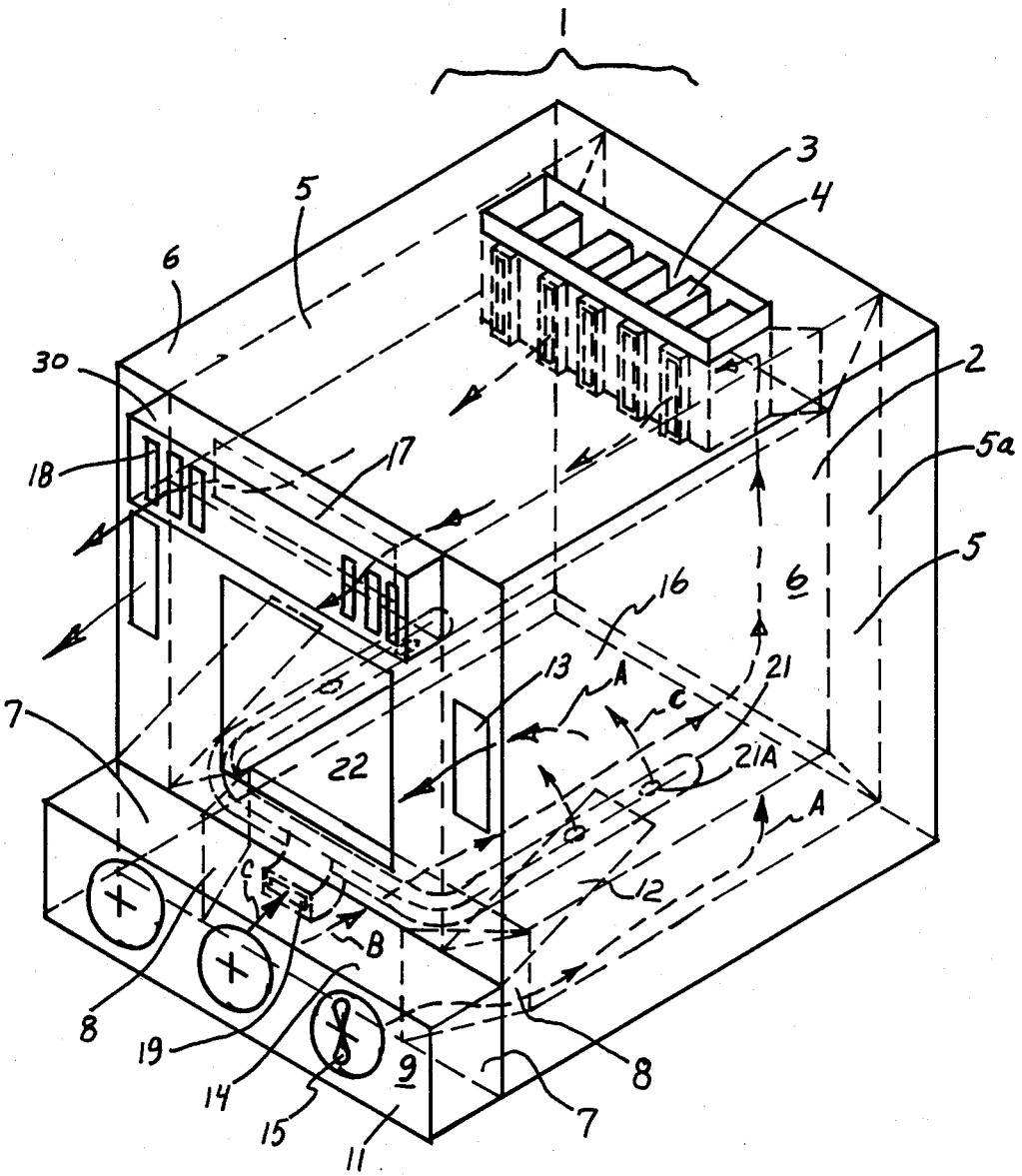
FIG. 1 is a shadow line perspective view of a device within the scope of the present invention provided to illustrate the baffling system and air flow pattern provided by devices in accordance with the present invention.

Referring first to FIG. 1 which is provided in shadowline to illustrated the general air flow through an example of a device within the scope of the present invention, an outer casing 1 is provided having an internal combustion chamber 2 located in spaced relation from the side walls as shown.

Baffle means **5*a* are provided to surround the edges of chamber 2 and extend to casing 1 to form plenums 6 at each side of chamber 2. Baffles 5*a* can also support and locate chamber 2 in casing 1. Inlet baffles 8 are provided to define inlets 7 to plenums 5 where inlets 7 communicate with an inlet plenum 9 defined by a casing 11 which receives fan 15**.

In the arrangement shown air flow means, for example fans 15 (shown schematically) are provided in the unit to supply air, both combustion air and air to be heated as described hereinafter, from the space to be heated. An exhaust duct 3 is provided communicating with combustion chamber 2 for emission of combustion products from the combustion chamber where flow conduits 4 are provided transversely across the exhaust 3 so that air to be heated can pass through the ducts for additional heating.

As shown by arrows A one stream of inlet air from plenum 9 flows through inlets 7 into plenum 6 between the side of combustion chamber 2 and the outer casing 1. Baffle 8 is provided to direct the air stream as shown so that the air circulates around the side of chamber 2 and is directed by an angularly disposed baffle 12 so the air flows to a heated air outlet 13. A similar configuration is shown on the opposite side of the arrangement.

A portion of the inlet air stream flows through an opening 14 beneath the bottom 16 of combustion chamber 2 back of the combustion chamber through a plenum 6A defined between outer casing 1 and chamber 2 through the ducts 4 and is emitted through an outlet 17 in the front of an outlet plenum chamber 30 and outlets 18. Combustion air stream C is admitted through inlet 19 to a combustion air distributor 21 for example a horseshoe shaped conduit with air outlets 21A (FIG. 1) located in combustion chamber 2 so that the air stream C provides combustion air.

Figure 6:
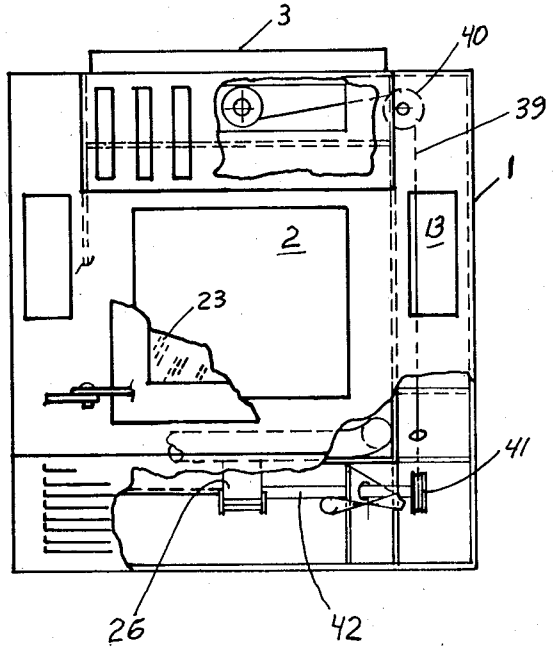
FIG. 6 is a front elevational view of the device of FIG. 1.

An opening 22 can be provided to load fuel in the combustion chamber 2 and a door 23 shown in FIG. 6, can be provided to close opening 22.

Figure 2:
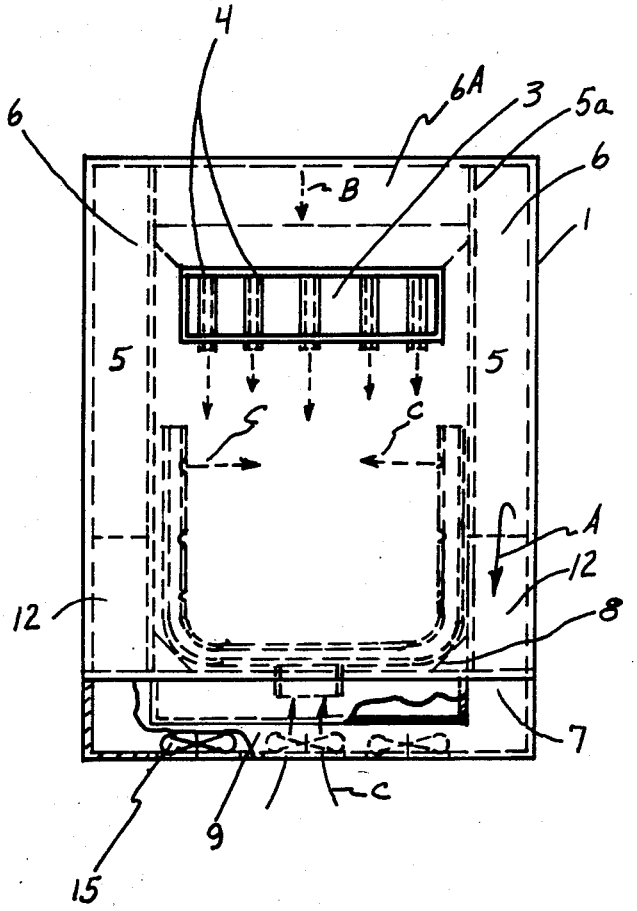
FIG. 2 is a sectional plan view of the device shown in FIG. 1 taken from the top.
Figure 3:
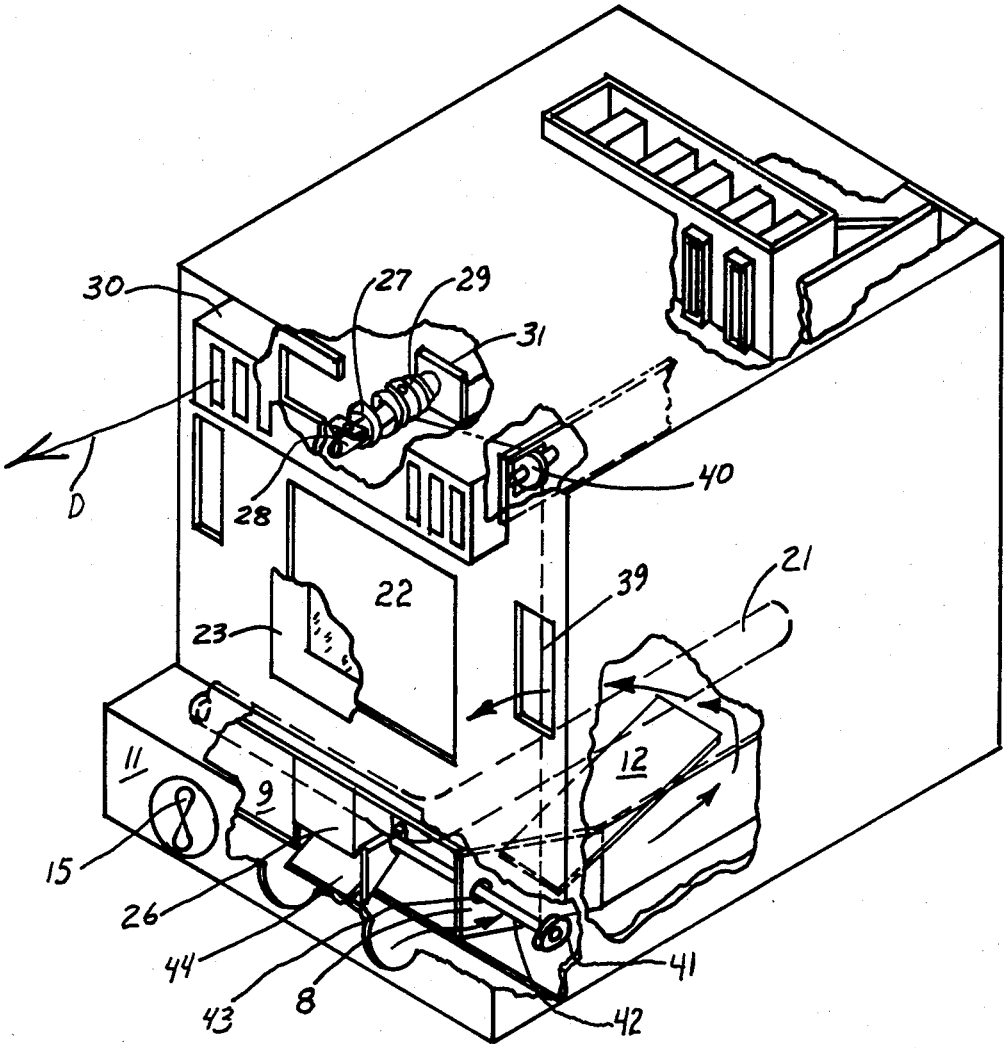
FIG. 3 is a perspective view, partially in section, of the device shown in FIG. 1 wherein an additional baffling is illustrated along with an illustration of an example of a control device within the scope of the present invention.

Referring to FIG. 3, an arrangement similar to that shown in FIG. 1 is illustrated except that the combustion air control device within the scope of the present invention is included. In the arrangement shown in FIG. 2 fans 15 are shown to introduce air to plenum chamber 9 as shown in FIG. 1. An alternative inlet conduit 26 is provided to communicate with a combustion air conduit 21 which is located within the combustion chamber 2 and can include perforations 21A to introduce air into the combustion chamber.

Figure 4:
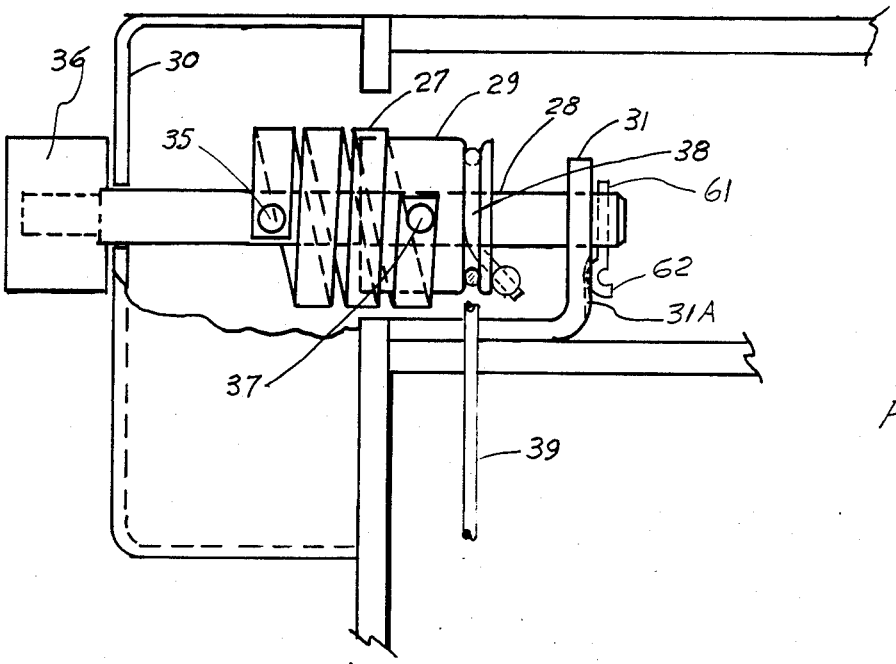
FIG. 4 is a detail view of one example of a bi-metal arrangement in accordance with the present invention.

In the arrangement shown, a bi-matellic element 27 is provided on a shaft 28 where a hub member 29 is provided to connect to shaft 28 to set the desired temperature of the outlet air. Bi-metal strip 27 is provided and connected to shaft 28 by means of a fastener 35, for example rivet or other suitable means as shown in FIG. 4. A bracket 31 is provided to rotatably receive shaft 28 and which extends through the front of outlet plenum chamber 30. As shown in FIG. 4 shaft 28 is journaled at the opposite ends in plenum 30 and bracket 31 where a keeper 61 is provided to hold the shaft in place. Keeper 61 includes a detent 62 which is spring biased by keeper 61 to be received in indents 31A of bracket 31 to secure shaft 28 in selected position.

Figure 5:
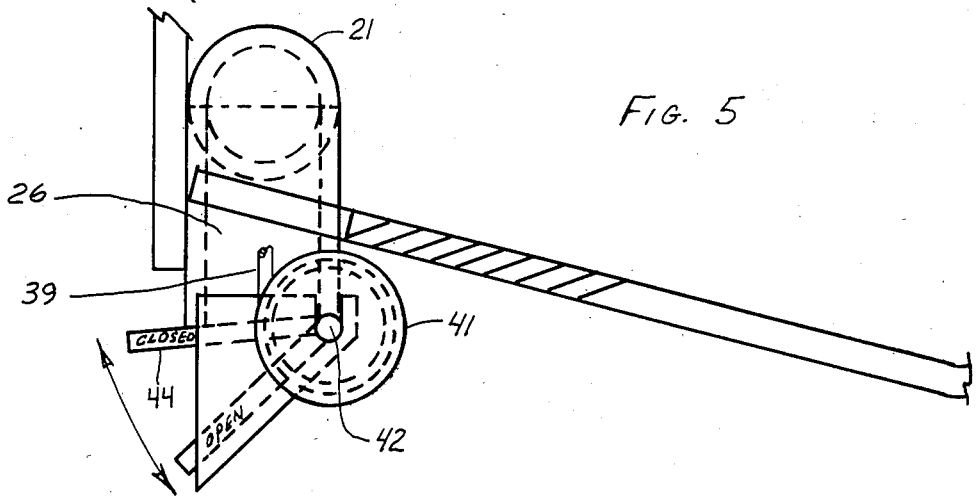
FIG. 5 is a detail view, of one example of a combustion air baffle arrangement in accordance with the present invention.

In accordance with one feature of the present invention the bi-metallic assembly is located in outlet plenum 30 so that air flow to combustion air distributor 21 is regulated as described hereinafter, in response to change in outlet air temperature. In operation shaft 28 is rotated to a selected position by a knob 36 carried on the outside of plenum 30. Hub 29 is fully rotatable on shaft 28. As previously described, one end of metallic strip 27 is connected to shaft 28 by means of a fastener 35. The other end of bi-metallic strip 27 is connected to hub 29 for example by a rivet 37 so that as bi-metallic strip 27 expands and contracts hub 29 is rotated on shaft 28. Hub 29 includes a pulley section 38 to receive a flexible cord 39 which is secured at one end to hub 29. Cord 39 extends downwardly as shown in FIG. 6 over an idler pulley 40 and is received on a pulley 41 (FIG. 5) connected to a shaft 42.(FIG. 6).

Figure 7:
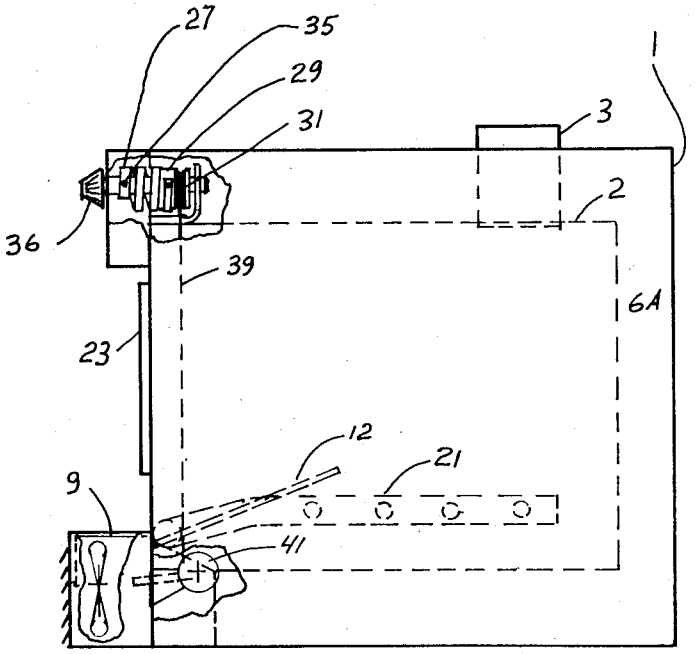
FIG. 7 is a side elevational view of the device of FIG. 1.

In FIG. 6 shaft 42 is journaled in aperture 43 in baffle 8. A louver 44 is pivoted on shaft 42 to open and close the inlet to conduit 26 as obvious in FIG. 5 which provides combustion air to distributor 21. Cord 39 rotates pulley 41 to rotate shaft 42. In operation shaft 28 is rotated to a selected set point where louver 44 is positioned to admit combustion air to combustion chamber 2 to maintain a selected outlet air temperature. Upon decrease in the temperature of the outlet air in plenum 30 bi-metallic strip 27 rotates hub 29 to draw cord 39 to move louver 44 to increase combustion air flow. Likewise, upon increase in outlet air temperature bi-metal element 27 rotates hub 29 to close louver 44 to reduce combustion air flow. In accordance with the present invention it has been found that regulations of combustion air flow in response to changes in outlet air temperature provides uniform heating and further provides a useful means of fuel conversion. The arrangement also is shown in FIG. 7 which is a elevational view in section of the louver arrangement shown in FIG. 3 and the orientation of louver can be seen as well as the orientation of the elements with respect to bottom 16 of chamber 2.

Figure 9:
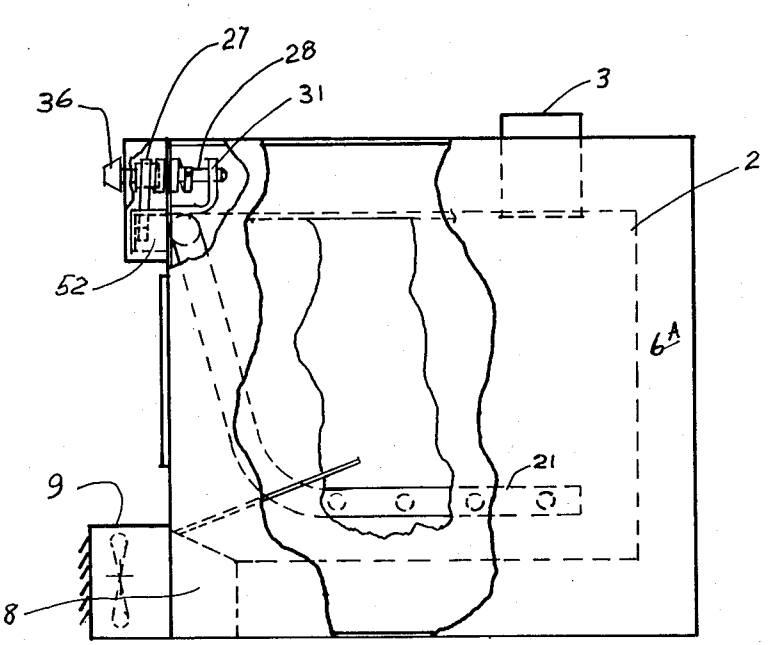
FIG. 9 is a side view of the arrangement shown in FIG. 8.
Figure 8:
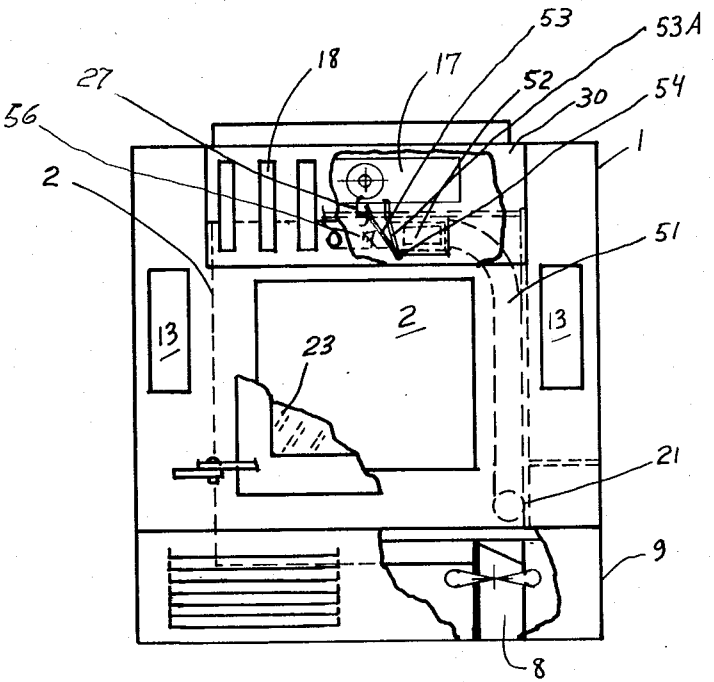
FIG. 8 is a front view partially in section of another arrangement within the scope of the present invention.

FIGS. 8 and 9 illustrate alternative embodiment in accordance with the present invention where a combustion chamber construction similar to that shown in FIGS. 1, 2, 3, 4, 5, 6 and 7 is provided except for the fact that combustion air is supplied by means of a conduit 51 which supplies heated air to the combustion air conduit 21 from plenum 30. Specifically, a inlet 52 is provided to plenum 51 at a location below an outlet 17 in housing 1. A damper 53 is provided to rotate about a pivot 54. A stop 56 is provided to limit movement of damper 53 in one direction and where the movement of the damper is stopped by conduit 51 in the closed position. Air is supplied from outlet 17 to inlet 52 to conduit 51 when damper 53 is open and combustion air flow is stopped when the damper is in the position as shown as 53A. Damper 53 is operated as shown in FIG. 9 by means of an arrangement similar to that shown in FIG. 3 including a shaft 28 carrying a knob 36 for adjustment of the position of the shaft where shaft 28 is carried in a bracket 31. In the arrangement shown, bimetal strip 27 is not attached to damper 53. Contact is maintained by the weight of damper 53 causing it to rotate in the direction (counter-clockwise) of strip 27. However, strip 27 can be rotated (by shaft 28) such that it will no longer be contacting damper 53. Damper 53 will at this time be resting n stop 56 (as shown in FIG. 8).

It is to be understood that FIGS. 8 and 9 are simply alternative embodiments of the arrangement shown in the previous Figures and illustrate but one other example in accordance with the present invention. It will be further understood that various other arrangements also within the scope of the present invention will occur to those skilled in the art upon reading the disclosure set forth hereinbefore.

Various other arrangements also within the scope of the present invention will occur to those skilled in the art upon reading the disclosure set forth herein.

The invention claimed is:

1. A heating device including a combustion chamber for burning a selected fuel;

an outer casing surrounding a portion of said combustion chamber and defining a plenum chamber therebetween having an ambient air inlet and a heated air outlet to emit air from said plenum chamber after said air has been heated by contact with said combustion chamber;

fan means to supply ambient air to said plenum chamber means air inlet;

conduit means having an inlet to receive air from said fan means and outlet communicating with said combustion chamber to supply combustion air to said combustion chamber;

combustion air flow control damper means located adjacent said conduit means to regulate air flow through said conduit means;

bi-metallic temperature sensing element means located in said outlet of said plenum chamber and connected to said damper means to attenuate flow of combustion air to said combustion chamber in response to change in temperature of air emitted through said plenum chamber means air outlet wherein said bi-metallic strip is mounted on shaft means journaled at opposite ends with one for rotation wherein one end of said bi-metallic strip is secured to said shaft means with said bi-metallic strip wrapped at least one time around said shaft means with the opposite end of said bi-metallic strip fixed to pulley means carried by said shaft means where said pulley means carries cord means which is fed out and withdrawn as said shaft is rotated by movement of said bi-metallic strip in response to said temperature change which moves said damper means in response to movement of said cord means wherein said shaft means further includes position adjustment means to adjust the position of said shaft means independent of the position of said bi-metallic strip.

2. The invention of claim 1 wherein said damper means is located at the inlet to said conduit means and where said inlet to said conduit means is located beneath said combustion chamber.

* * * * *